US005514187A

United States Patent [19]

McFarland et al.

[11] Patent Number: 5,514,187

[45] Date of Patent: May 7, 1996

[54] REDUCED INDIGO DYE PENETRATION

[75] Inventors: James E. McFarland, Mooresville, N.C.; Ellis Davis, Jr., Easley, S.C.; Edward W. Teague, Raleigh, N.C.

[73] Assignee: Burlington Industries, Inc., Greensboro, N.C.

[21] Appl. No.: 309,158

[22] Filed: Sep. 20, 1994

[51] Int. Cl.[6] ..... D06P 7/00; D06P 5/02; C09B 67/00

[52] U.S. Cl. ..... 8/401; 8/481; 8/555; 8/552; 8/650; 8/653; 8/543; 8/918; 8/108.1; 8/114.6

[58] Field of Search ..... 8/401, 478, 481, 8/485, 650, 653, 918, 555, 552, 108.1, 114.6

[56] References Cited

U.S. PATENT DOCUMENTS

| | | | |
|---|---|---|---|
| 4,036,587 | 7/1977 | Wolf et al. | 8/653 X |
| 4,166,717 | 9/1979 | Fono et al. | 8/653 |
| 4,852,990 | 8/1989 | Patterson . | |
| 5,006,126 | 4/1991 | Olson et al. . | |
| 5,350,423 | 9/1994 | Davis et al. . | |

FOREIGN PATENT DOCUMENTS

| | | |
|---|---|---|
| 5031854 | 2/1993 | Japan . |
| 1775522 | 11/1992 | U.S.S.R. . |

*Primary Examiner*—Margaret Einsmann
*Attorney, Agent, or Firm*—Nixon & Vanderhye

[57] ABSTRACT

Open end spun cotton yarns are ring dyed with a thickened dyebath to limit dye penetration to the outer circumference of the yarn leaving a substantial undyed core. Stonewashed indigo dyed denim fabrics and garments are prepared.

33 Claims, No Drawings

REDUCED INDIGO DYE PENETRATION

This invention relates to procedures for controlling the depth of dye penetration into spun yarns of cellulosic fibers.

BACKGROUND OF THE INVENTION

Stonewashing of cotton and cotton blend fabrics has gained great popularity and provides many styling applications in today's apparel market. This effect is chiefly applied to denim products but may be applied to cotton goods treated with vat, sulfur, reactive, direct and naphthol dyes, as well as pigments. Typically ring dyed yarns are woven and are then normally treated according to various so-called "stonewashing" processes that may or may not include abrasive materials to remove portions of the outer blue dyed yarns partially exposing the white portion of the yarn underneath. Stonewashing is costly and time consuming. The term "stone washing" and related descriptions herein refers to the use of abrasive stones such as pumice, cellulase enzymes or other treatments used to abrade fabrics or garments.

The traditional procedure for providing a stonewashed appearance to garments is to expose the garment, typically denim jeans, to a combination of bleaching and an abrasive material. This combination provides a faded, worn appearance and is achieved by tumbling the garments with an abrasive substance, typically pumice stones and usually also with a bleaching solution such as potassium permanganate, a chlorine-based bleach or the like. Typically the garment to be stonewashed is denim or other type of cotton fabric or a predominantly cotton garment in which the cotton yarn is ring dyed. When examined in cross section, the cotton fibers of the ring dyed yarn are dyed only around the outer circumference of the cotton yarn leaving the center portion or core undyed, hence the term "ring dyed" when the yarns are viewed in cross section. Removal, such as by abrasion or other means, of a portion of the ring dyed outer surface of the yarn will leave the undyed portion exposed to view thus giving the faded appearance of a garment that has been worn for a considerable period of time. Abrasive treatment also imparts a worn, weathered appearance. In addition, the stonewashing process softens the hand of the garment giving it a more comfortable, less rigid, familiar feel and comfort when worn.

Conventional stonewashing procedures are time consuming and costly and provide garments which sometimes vary from batch to batch. In addition, stonewashing is usually performed on finished garments, that is garments in the completely constructed or fabricated condition. It would be desirable to provide a procedure that assures more uniform results prior to actual construction of the garment.

Stonewashed cotton fabrics with best washed appearance are usually woven from ring spun yarns that are ring dyed. Indigo dye tends to dye the outside of the fiber bundle in a ring spun cotton yarn or fabric without penetrating into the core of the yarn or body of the fabric. When the dyed surface is worn or abraded away (e.g., in a washing machine with stones or a combination of stones and cellulose enzyme), such ring dyeing allows the inner white areas to show through. It is more difficult to achieve this effect when using cotton yarns made on open end spinning systems which are looser in cross section and therefore are more easily penetrated during dyeing, increasing the time needed to achieve the desired stone washing result.

The present invention achieves the desired worn, stonewashed appearance of ring dyed denim and other types of woven cellulosic fabrics from open end spun yarns by providing a controlled penetration of the indigo dye into the surface of the yarn and/or fabric such that further processing, primarily stonewashing or simulated stonewashing, will result in the desired level of exposure of the undyed fibers to provide the appropriate stonewashed fabric appearance in a shorter period of time or at a reduced cost or, preferably, both. We call this procedure of dyeing "RL" in the following description of the process and end results.

DESCRIPTION OF THE INVENTION

Our invention provides a procedure to inhibit the dye penetration which enhances the ring dyed effect on open end spun yarns thus shortening the stonewashing or cycling time and reducing costs to produce the same or similar effect obtained when stonewashing denim woven from ring spun yarns that are ring dyed. Yarns prepared on open end spinning equipment are not as compact as yarns produced on ring spinning equipment. As a result, when open end spun yarns are indigo dyed, the indigo dye penetrates the yarn more deeply, necessitating a longer and therefore more expensive stonewashing cycle in order to obtain the same stonewashed or bleached effect as is obtained more easily with a denim fabric made of ring spun yarn. The process of this invention makes open end spun yarn comparable to ring spun yarn in stonewashing time, expense and overall appearance.

This invention provides a controlled level or depth of indigo dye penetration of open end spun cellulosic yarns to a depth for example of less than about 20% and preferably at most about 16 to 18% of the overall cross-section of the yarns by changing the composition of the indigo dye formula thereby reducing penetration of the dye into the fiber bundle during indigo dyeing. The control dyeing without the dyebath modification had penetrated 25% of the fiber bundle.

The level or depth of indigo dye penetration of two open end spun cotton yarns using a sample prepared according to the process of Example 1, identified as "RL" and a second sample prepared in the same manner without the use of a viscosity control agent (control) was assessed by examining cross sections of each sample under an electron microscope at 237.5× magnification. The inner and outer circumference of the indigo dye outer ring was measured relative to the size of the undyed center core in two dimensions (length, width) and the relative depth of penetration was calculated as follows:

| | Example I "RL" | Example II Control |
|---|---|---|
| DYED OUTER RING | | |
| Length - Diameter | .044 mm | .044 mm |
| Width - Diameter | .036 mm | .037 mm |
| TOTAL | .080 mm | .081 mm |
| Average Diameter Overall | .040 mm | .0405 mm |
| UNDYED WHITE CORE | | |
| Length - Diameter | .0355 mm | .0325 mm |
| Width - Diameter | .0300 mm | .0275 mm |
| TOTAL | .0655 mm | .0600 mm |
| Average Diameter | .0328 mm | .0300 mm |

COMPARISON OF YARN X-SECTION AREAS PENETRATED BY INDIGO DYE

| Example I | Example II |
|---|---|
| Overall − Core ÷ Overall | Overall − Core ÷ Overall |
| (.040 − .0328) ÷ .040 = 18% | (.0405 − .030) ÷ .0405 = 25% |

-continued

COMPARISON OF YARN X-SECTION AREAS NOT PENETRATED CONTROL - OVERALL AREA

Average Diameter = (.044 + .037) ÷ 2 = .0405 nm $$\text{Overall Area of X-Section} = \left(\frac{.0405}{2}\right)^2 \times 3.14 = .0012874 \text{ sq mm}$$

$$\text{Core Diameter} = \left(.\frac{03}{2}\right)^2 \times 3.14 = .0007065 \text{ sq mm}$$

Core area ÷ Overall Area = % not penetrated
= 54%

"RL" - OVERALL area $$\text{Overall Area of X-Section} = \left(.\frac{04}{2}\right)^2 \times 3.14 = .001256\text{mm}^2$$

$$\text{Core Average Diameter} = \left(.\frac{0328}{2}\right)^2 \times 3.14 = .000844 \text{ mm}^2$$

Core Area ÷ Overall Area = % not penetrated = 67%

The depth of dye penetration can also be easily determined by empirical procedures and from a practical standpoint by how quickly it stonewashes versus a control produced by standard dyeing. Our experience indicates that the extent of dye penetration into the yarn bundle, expressed as area of undyed core related to the overall cross-section of the fiber bundle, is between 45 and 60% undyed core on standard commercial indigo dyeing and between 65 and 70% undyed core according to the process of this invention. When stonewashed, undyed core in the range of 65 to 70% range reliably results in the desired stonewashed appearance, hand and finish.

An additional decrease in dye penetration also shows on the individual cotton fibers on the outside of yarn bundle which have been exposed to the dyebath. On the Example II control, indigo dye penetrated 50–65% of the cotton fiber whereas in Example I according to the present invention, the depth of indigo into the individual cotton fibers is only 30–40% of the fiber cross section.

Both of the above indigo dye penetrations of the invention allow the cellulase/stones to abrade through the dyed portion of the yarn more quickly, allowing the white yarn core to show the stonewashed look. The thinner the dyed ring in the fibers and the yarn bundle, the less abrasion is needed to remove this dyed ring from the yarn or fabric.

A great deal of work has been done by indigo dyers to make the dyed ring around the yarn bundle thinner, as the thinner the dye ring the shorter time and amount of abrasion needed to achieve the stonewashed look of dyed areas and white areas where abrasion has occurred. These changes in dye procedure include:

a. reducing submersion time in dye from 15–30 seconds to 3–8 seconds.
b. reducing pH of the dye bath from 12–13 to 10.5–11.5 pH to make the indigo strike (dye) faster and stay on surface of yarn.
c. pretreat with caustic in order to make the indigo strike (dye) faster and stay on the surface of the yarn.
d. reduce scouring and cleaning out of cotton impurities and waxes before dyeing to reduce absorbency.

Our invention goes above and beyond prior efforts at minimizing depth of penetration and maximizing the amount of white core in the yarn after dyeing.

According to the present invention dye penetration is conveniently controlled and attenuated by modifying the indigo dyeing composition with small amounts of suitable thickening agent compatible with the dye composition and having molecular weights in a range of 5000 to 30 million. The viscosity of the dye composition is open to wide variation because of the different composition of thickeners. However, viscosities in the range of 0 (undetectable) to 35000 cps are suitable for reducing penetration of dye into the fiber and yarn bundle. Additions of thickener in relatively small amounts (on a weight basis), for instance as used in the example that follows of 0.1% solids cannot be measured in viscosity but are most suitable for running in indigo dyeing equipment as it reduces roll buildup of dye during dyeing.

Suitable thickening or viscosity controlling agents include natural starch, British gum, crystal gum, natural and etherified locust bean gums, carboxymethyl cellulose, gum tragacanth, polyacrylic acid sodium salt and sodium alginate, provided that the agent selected is soluble in the dye composition and capable of forming a stable, homogeneous dye composition of appropriate concentrations to be able to be used in practice. Preferably, the thickening agent will be of a polyacrylamide type with a molecular weight range of about 5000 to 30,000,000 and will be present in an amount sufficient so that the resulting composition will have concentration ranging between about 0.03% and 2% solids depending on the thickening agent used.

The dye is applied to the open end spun yarns using any convenient procedure on equipment customarily used for dyeing denim and similar fabrics. Subsequent stonewashing may be by physical abrasion with pumice stones, abrasive particles or the like, cellulose enzyme treatment such as described in U.S. Pat. No. 5,006,126 and/or the controlled embrittlement procedures described in our copending application Ser. No. 08/120,360 filed Sep. 14, 1993, now U.S. Pat. No. 5,350,423 the disclosure of which is hereby incorporated by reference.

Fabrics suitable for the process of the present invention are cellulosic fabrics, primarily cotton or cotton blends and regenerated cellulose in typically denim-type products. In addition to indigo dyed denim products, the procedure according to the invention can be applied to all types of cotton yarn dyed with many other classes of dyes including other vat dyes, sulfur dyes, reactive dyes, and naphthols. Best stonewashed results are on cellulosic yarns that have been dyed such that when the dyed yarn is subjected to chemical processing, partial enzymatic digestion, embrittlement and/or physical abrasion, a portion of the dye about the circumference of the yarn is removed revealing at least in part the underlying undyed fiber and giving the desired appearance. The procedure of the invention enables shorter overall processing time, less time during the stonewashing/abrasion procedure and therefore reduces costs, and increases product output.

The fabric is examined to determine the amount of white core from the ring dyed yarns that shows on the surface of the abraded fabric. The amount of white undyed fiber showing on the surface of the fabric is directly proportional to the amount of dye and fiber removed by abrasion.

The invention is further illustrated by the following non-limiting example in which all parts and percentages are by weight and temperatures are reported in °F. unless otherwise indicated.

EXAMPLE

Denim fabric woven from 6.10/1 open-end spun yarn made on a Schlafhorst spinning machine using 40 mm rotors was dyed with a dye composition consisting of

| | |
|---|---|
| indigo, 20% paste | .45 ounces per gallon |
| free sodium hydrosulfite | .10 grams/liter |
| free caustic (NaOH) | 5 grams/liter |
| NaCl | 50 grams/liter |
| polyacrylamide thickening agent (Pomosist 117), Piedmont Chemical | .1% solids |
| pH | 10.8 |

The yarn was prescoured for 20 seconds at 190° F. in a bath containing:

| | |
|---|---|
| Southern Dye Company Sulfur Black B-46 | 1.2% |
| Sodyefide B (Sandoz) | 1.44% |
| NaOH (50%) | .64% |
| Non-ionic scouring agent (Sedgemul S-195, Sedgefield Chemical) | .33% |

The yarn was rinsed two times in water at 120° F. and dyed 5 dips through the indigo dye maintained at 80° F. with one minute of skying in air after each dip.

The dyed yarn was warm washed through four washes at 120° F. and dried on steam heated cans. The dyed yarn was wound on section beams and slashed with corn starch containing 0.45% sulfonated tallow to a 9% add-on of solids.

Warps from the section beams were woven with a conventional denim filling yarn (e.g. open end spun cotton), followed by finishing on a tenter frame with 1% corn starch, 1.5% high density polyethylene and 0.3% non-ionic rewetter to set the width, and by compressive shrinking to compress the fabric and reduce the shrinkage down to 2.5%.

The finished fabric was sewed into jeans and stonewashed in a 30-pound Unimac stonewash machine along with a control of identical fabric that was dyed without the polyacrylamide in the dyebath.

Both jeans were stonewashed as follows:

Desize: 140°—15 minutes with 2% (alkaline-built detergent (Vircoscour NLF), fatty acid softener (Vircosoft 348) and 8 pounds stones. 2 minute rinse @ 140° F.

Abrasion: 140° F. for 40 minutes with 2% cellulose enzyme (Virkler Quickstone) and 8 pounds of pumice stones followed by a 3 minute rinse @ 140° F.

Bleach and Soften: 140° F. high water level bleach with sodium hypochlorite to visual match versus standard. 140° F. high water rinse with 15 grams of antichlor (sodium bisulfite). 110° F. eight minute rinse with 3% Vircosoft SLP3.

The above Virco and Virkler products are available from The Virkler Company, 12345 Steele Creek Road, Charlotte, N.C. 28273.

Comparison of the stonewashed shade of the two samples showed that the sample prepared using the thickened dye composition of the invention, on average, was eight digits lighter compared to the control fabric made without the thickening agent, measured on a spectrophotometer (Hunter Labs.). Readings ranged from a 5 reading on depth to a 13.

Color depths were measured using a Hunter Lab Ultrascan Xe spectrophotometer, using two sample thicknesses, and averaging the four measurements. Color strength calculated on the weighted summation method shows the product of the present invention to be 61.84% of the shade strength of the control after stone washing.

The larger white core achieved by the process of this invention and the thinner dye ring allowed the abrasion from the stonewashing to more quickly wear away more of the thinner dye ring, permitting more of the undyed core fibers to intermingle with dyed ones to show the lighter shade after stonewashing.

We claim:

1. A continuous process of controlling the depth of dye penetration and enhancing the ring dyed effect on open end spun cellulosic yarns comprising immersing open end spun cellulosic yarns into a dyebath containing in addition to the dye or dyes at least one polymeric thickening or viscosity control agent compatible with the dye and present in an amount to provide dye penetration of the outer fibers of less than about 20% of the overall cross-section of the yarn with the remaining fibers being substantially undyed core.

2. The process of claim 1 in which the percent of dye penetration of the yarn is at most about 18%.

3. The process of claim 1 in which the percent of dye penetration of the yarn is at most about 16%.

4. The process of claim 1 in which the dye is a vat dye, sulfur dye, reactive dye, a naphthol and the yarn is cotton.

5. The process of claim 4 in which the vat dye is indigo.

6. A continuous process of altering and minimizing dye penetration into open end spun cellulose yarns to dye the outer fibers and maximizing the amount of white undyed core in the yarn after dyeing, the process comprising immersing open end spun cellulose yarns into a dyebath containing a polymeric thickening agent having a molecular weight of from 5,000 to 30 million present in an amount sufficient so that the dyebath will contain between 0.03 to 2% solids, thereby limiting dye penetration to the outer fibers to less than about 20% of the overall cross-section of the yarn and leaving the remaining fibers as a substantially undyed core.

7. The process of claim 6 in which the dye is indigo and the yarn is cotton.

8. Ring dyed open end spun cellulose yarns produced by the process of claim 6.

9. A continuous process for providing a washed and worn appearance and softened hand to a cellulosic fabric comprising the steps of:

(a) dyeing open end spun cellulosic yarns by immersing said yarns into a dye bath containing an amount of a polymeric thickening agent sufficient to limit the amount of dye penetration into the open end spun cellulosic yarn to less than about 20% of the overall cross-section of the yarn leaving a ring dyed outer surface and a substantially undyed core;

(b) forming a fabric using as a warp yarn the yarns dyed in step (a) and untreated open end cellulosic yarn as the fill yarn; and (c) abrading the fabric formed in step (b) to remove at least a portion of the outer surface of the ring dyed cellulosic fibers therein revealing the underlying undyed portion of the ring dyed cellulosic yarn to provide a fabric having a washed and worn appearance and softened hand.

10. The process of claim 9 in which the cellulosic fabric is cotton.

11. The process of claim 10 in which the fabric is indigo dyed cotton denim.

12. The process of claim 9 in which the fabric is stonewashed in step (c) with pumice stones and a chlorine bleach.

13. The process of claim 9 in which subsequent to step (c) the fabric is compressively shrunk.

14. The process of claim 9 in which the fabric is constructed into a garment prior to step (c).

15. The process of claim 14 in which the garment is abraded in step (c) by tumbling with pumice stones in an aqueous hypochlorite solution.

16. The process of claim 14 in which the garment is treated in step (c) with a cellulase enzyme to remove the cellulosic fibers from the outer surface of the ring dyed yarns.

17. A stonewashed, faded garment produced by the process of claim 14.

18. The process of claim 9 in which the treated fabric in step (c) is abraded with pumice stones.

19. A continuous process of controlling the depth of dye penetration and enhancing the ring dyed effect on open end spun cellulosic yarns comprising immersing open end spun cellulosic yarns into a dyebath containing in addition to the dye or dyes at least one polymeric thickening or viscosity control agent compatible with the dye in an amount sufficient to limit dye penetration in the yarn leaving an undyed core of at least about 65%, expressed as area of dyed outer fibers related to the overall cross-section of the yarn, the remaining fibers surrounding the core being dyed.

20. The process of claim 19 in which the percent of dye penetration of the outer fibers of the yarn is at most about 20%.

21. The process of claim 19 in which the dye is indigo and the yarn is cotton.

22. Ring dyed open end spun cellulose yarns produced by the process of claim 19.

23. The process of claim 19 in which the percent of undyed core of the yarn is in the range of about 65% to about 75%.

24. A continuous process for providing a washed and worn appearance and softened hand to a cellulosic fabric comprising the steps of:

(a) dyeing open end spun cellulosic yarns by immersing said yarns into a dyebath containing an amount of a polymeric thickening agent sufficient to limit the amount of dye penetration into the open end spun cellulosic yarn leaving an undyed core of at least about 65% of the overall cross-section of the yarn and dyed fibers surrounding the undyed fiber bundle; and (b) forming a fabric using as a warp yarn the ring dyed yarn of step (a) and untreated open end cellulosic yarn as the fill yarn; and (c) abrading the fabric formed in step (b) to remove at least a portion of the outer surface of the ring dyed cellulosic fibers therein revealing the underlying undyed portion of the ring dyed cellulosic yarn to provide a fabric having a washed and worn appearance and softened hand.

25. The process of claim 24 in which the cellulosic fabric is cotton.

26. The process of claim 25 in which the fabric is indigo dyed cotton denim.

27. The process of claim 24 in which the fabric is stonewashed in step (c) with pumice stones and a chlorine bleach.

28. The process of claim 24 in which subsequent to step (c) the fabric is compressively shrunk.

29. The process of claim 24 in which the fabric is constructed into a garment prior to step (c).

30. The process of claim 29 in which the garment is abraded in step (c) by tumbling with pumice stones in an aqueous hypochlorite solution.

31. The process of claim 29 in which the garment is treated in step (c) with a cellulase enzyme to remove the cellulosic fibers from the outer surface of the ring dyed yarns.

32. A stonewashed, faded garment produced by the process of claim 29.

33. The process of claim 24 in which the treated fabric in step (c) is abraded with pumice stones.

* * * * *